US006210191B1

(12) United States Patent
Sai

(10) Patent No.: US 6,210,191 B1
(45) Date of Patent: Apr. 3, 2001

(54) WATERPROOF ELECTRICAL CONNECTOR WITH PRESSURE REDUCING STRUCTURE

(75) Inventor: Noriaki Sai, Kanagawa (JP)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/213,577

(22) Filed: Dec. 17, 1998

(30) Foreign Application Priority Data

Dec. 26, 1997 (JP) ..... 9-367924

(51) Int. Cl.[7] ..... H01R 13/52; H01R 4/60; H01R 4/64

(52) U.S. Cl. ..... 439/274; 439/198

(58) Field of Search ..... 439/274, 275, 439/279, 271, 272, 273, 589, 587, 198, 199, 205, 206

(56) References Cited

U.S. PATENT DOCUMENTS

| | | | | |
|---|---|---|---|---|
| 3,522,576 | * | 8/1970 | Cairns . | |
| 3,643,207 | * | 2/1972 | Cairns | 439/201 |
| 3,821,690 | * | 6/1974 | Small . | |
| 4,373,767 | * | 2/1983 | Cairns | 439/275 |
| 4,948,377 | * | 8/1990 | Cairns | 439/200 |
| 5,194,012 | * | 3/1993 | Cairns | 439/201 |
| 5,356,304 | * | 10/1994 | Colleran | 439/205 |
| 5,358,420 | * | 10/1994 | Cairns et al. | 439/206 |
| 5,645,442 | * | 7/1997 | Cairns | 439/201 |
| 5,803,759 | * | 9/1998 | Griffith et al. | 439/274 |

FOREIGN PATENT DOCUMENTS

| | | |
|---|---|---|
| 25 16 280 | 10/1976 | (DE) . |
| 3512026 | 3/1986 | (DE) . |
| 576324 | 12/1993 | (FR) . |
| 592102 | 4/1994 | (GB) . |
| 292118 | 11/1998 | (GB) . |
| 7-326422 | 12/1997 | (JP) . |

* cited by examiner

*Primary Examiner*—Brian Sircus
*Assistant Examiner*—Chandrika Prasad

(57) ABSTRACT

A waterproof electrical connector comprises a structure intended for the reduction of air pressure trapped inside the connector during its coupling with a mating connector. The waterproof electrical connector (10) has a waterproof-sealing member (50) retained by an inner housing (20) and an outer housing (30). In a cavity (55) of a wire-sealing section (53) of the waterproof-sealing member (50), a deformable elastic thin-wall partition (56) is provided. The thin-wall partition (56) is deformed when the connector is coupled with a mating connector, thus reducing the air pressure inside the connector.

21 Claims, 2 Drawing Sheets

WATERPROOF ELECTRICAL CONNECTOR WITH PRESSURE REDUCING STRUCTURE

FIELD OF THE INVENTION

This invention relates to waterproof electrical connectors, especially to waterproof electrical connectors having a waterproof sealing means disposed at a mating end of a housing and waterproof sealing means providing watertight connection for a bundle of electrical wires.

BACKGROUND OF THE INVENTION

An example of a known waterproof electrical connector can be found in Japanese Patent Publication No. 95-326422. The waterproof electrical connector according to this publication has an integral rubber waterproof sealing means that is secured on a housing and is disposed at a mating side of the housing and at a side of the housing accommodating a bundle of electrical wires thereby providing a watertight seal for the bundle of wires. The rubber waterproof sealing means is applied from a back side of the housing, that is from the side accommodating the leads, and it is secured in position by a cap member. The rubber waterproof sealing means exerts a watertight connection when a mating housing of a mating connector is engaged with the connector housing, and its housing forms a waterproof coupling therebetween.

Connectors of this type must offer good waterproof properties in order to increase the reliability of the electrical connection. However, the measures aimed at the improvements of waterproof properties create trouble when the mating housings of the connector are coupled together. The reason for this is that in connectors with superior waterproof properties, when the mating housings of the connector are coupled together, air is locked in the space between the mating housings, and since there is no escape for the air, it remains inside the connector at a rather high pressure.

Therefore, the purpose of the present invention is to provide a waterproof electrical connector, the design of which makes it possible to reduce pressure of the air trapped between the mating housings of the mating connectors.

SUMMARY OF THE INVENTION

The waterproof electrical connector according to the present invention comprises a housing containing multiple electrical terminals for electrical connection to multiple electrical wires and having waterproof sealing means secured on the housing at a mating side of the housing to provide a watertight connection with a mating housing of a mating connector and at the side of the housing accommodating electrical wires that are passed through water tight openings therein wherein the waterproof sealing means has a deformable pressure-relieving structure intended to reduce pressure of the air trapped in the vicinity of the mating side inside the housing.

The pressure-reducing structure is made in the form of a thin wall that is molded in a cavity having a round cross section. The thin wall is best configured in the form of a dome.

Deformation or displacement of the pressure-reducing structure is of an elastic nature.

The pressure-reducing structure is made as a part of the wire waterproof-sealing member.

The pressure-reducing structure has a through hollow cavity facing the mating side of the housing. No electrical terminals shall be disposed inside the hollow cavity.

There are several hollow cavities and that at least one of them has a relatively narrow opening facing the mating side of the housing.

The hollow cavities are aligned with the pressure-reducing structure.

A waterproof electrical connector for matable connection with a mating connector comprises a housing having contact-receiving cavities in which electrical contacts are to be disposed, a waterproof-sealing member in the housing including a coupling-sealing section for sealing engagement with a mating housing of the mating connector and a wire-sealing section through which electrical wires to be electrically connected to the electrical contacts sealingly extend, wherein a pressure-reducing structure is provided by the wire-sealing section for reducing the air pressure that is trapped within the connector when it is mated with the mating connector.

BRIEF DESCRIPTION OF THE DRAWINGS

An embodiment of the present invention will now be described by way of example with reference to the accompanying drawings in which.

DETAILED DESCRIPTION OF THE INVENTION

Figure 1:
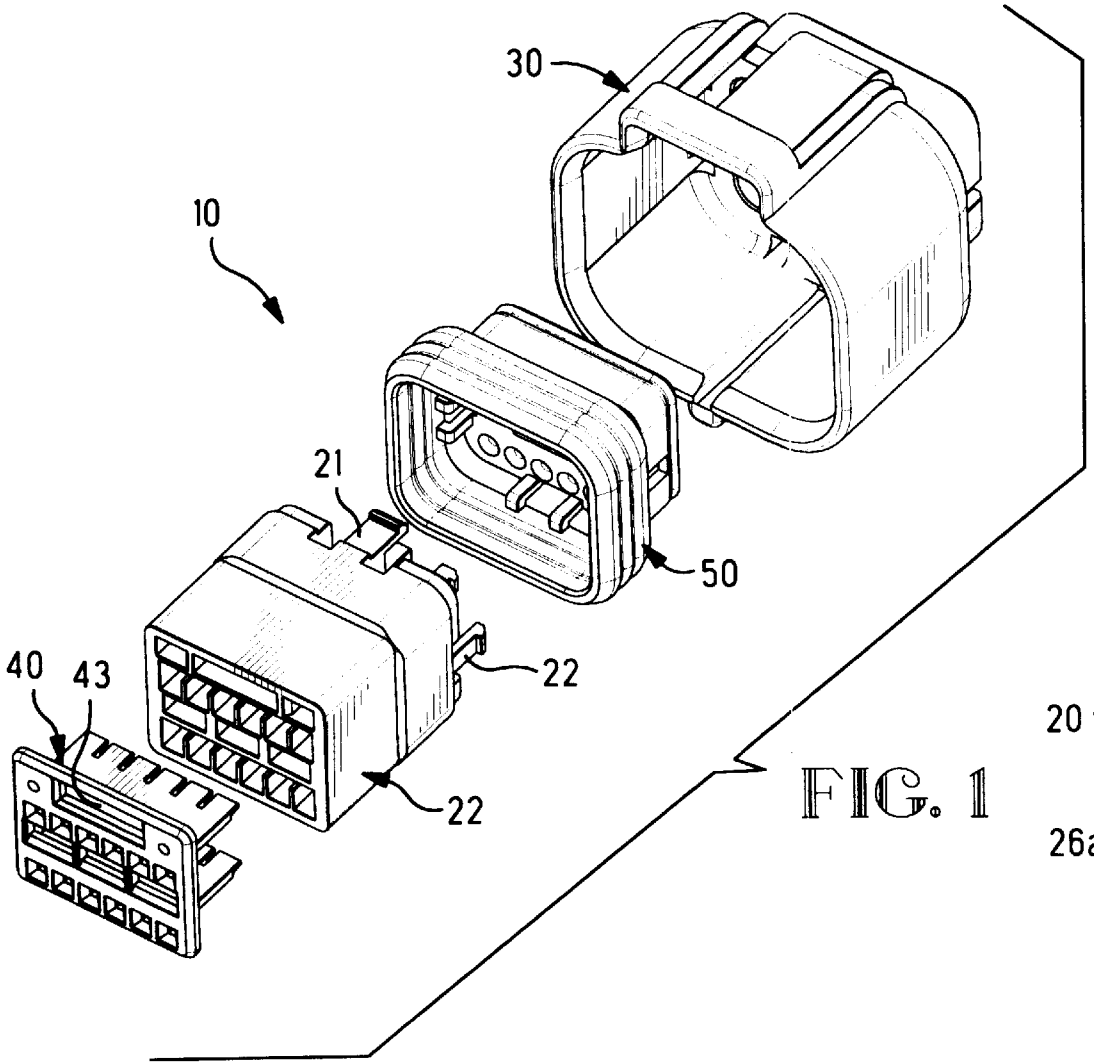
FIG. 1 is an exploded perspective view of a waterproof electrical connector according to the present invention.
Figure 2:
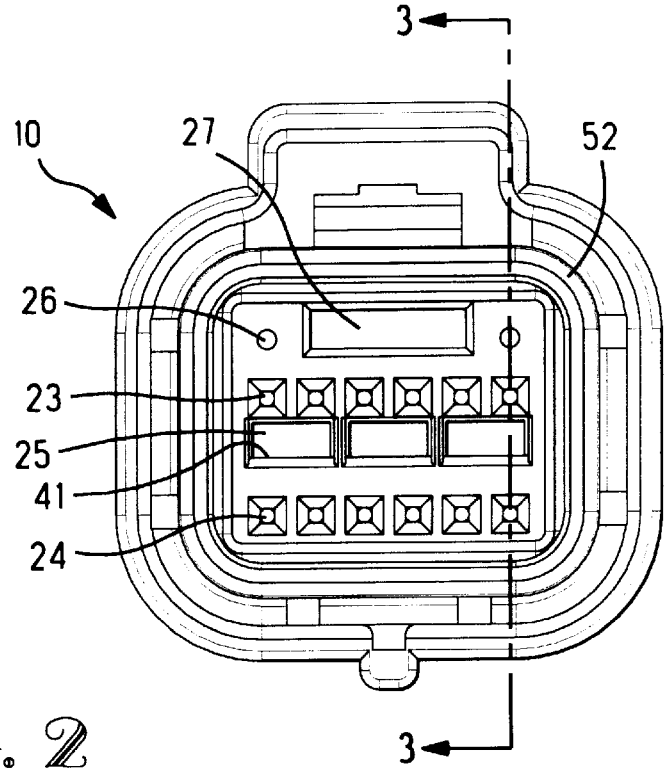
FIG. 2 is a front view of the waterproof electrical connector of FIG. 1.
Figure 3:
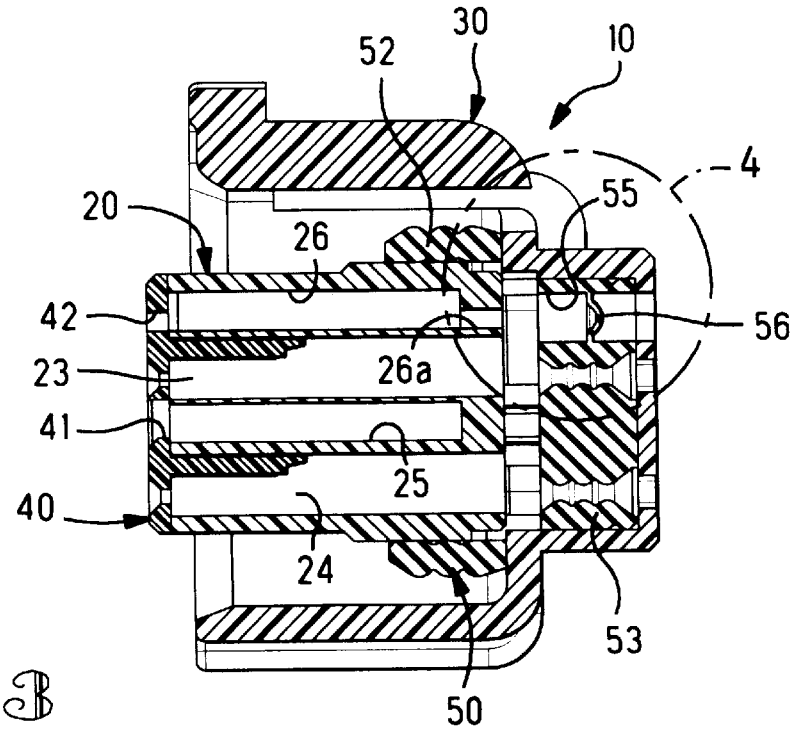
FIG. 3 is a cross-sectional view taken along line 3—3 in FIG. 2.

As can be seen from FIGS. 1–3, waterproof electrical connector 10 comprises an inner housing 20, an outer housing 30, a waterproof-sealing member 50 disposed between the housings that is fabricated from an elastic rubber material, and a retaining member 40 preventing electrical contacts or terminals (not shown) from being pulled out of the connector. At a rear end of the inner housing 20, flexible latching arms 21, 22 are provided. The latching arms 21, 22 are provided to secure the inner housing 20 to the outer housing 30. When the inner housing 20 is secured to the outer housing 30 by latches 21, 22, the waterproof-sealing member 50 is pressed between the inner housing 20 and the outer housing 30, thus forming a subassembly including the inner housing 20, the outer housing 30 and the waterproof-sealing member 50. The electrical contacts with electrical wires connected thereto are inserted in the inner housing 20, and the retaining member 40 is placed on the subassembly from the mating side, thus securing the contacts in the connector.

Figure 4:
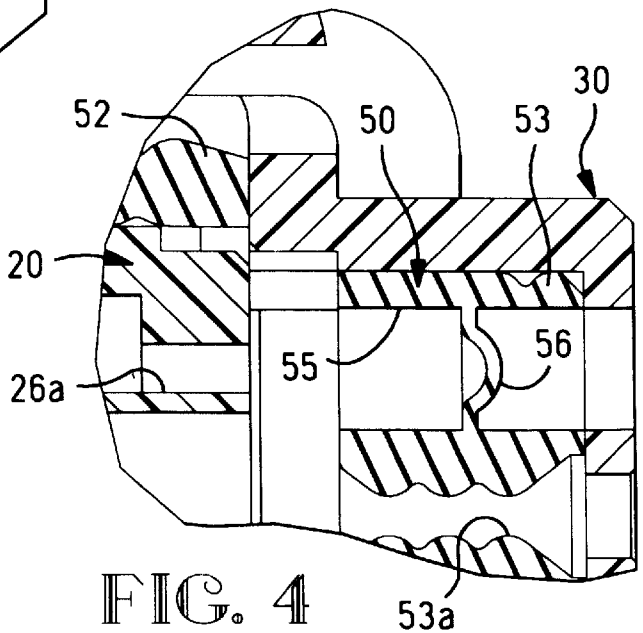
FIG. 4 is an enlarged cross-sectional view of detail B shown in FIG. 3.

FIGS. 2 through 4 show the waterproof electrical connector in the assembled state. As can be seen from FIGS. 2 and 3, when the waterproof-sealing member 50 is inside the assembly formed by the inner housing 20 and the outer housing 30, coupling-sealing section 52 is positioned for engaging a surface of a mating housing of a mating connector (not shown), and wire-sealing section 53 is accommodated in a rear end at an electrical wire outlet of outer housing 30. The coupling-sealing section 52 provides watertight sealing between the waterproof electrical connector 10 and the mating connector, and the wire-sealing section 53 provides watertight sealing for the bundled electrical wires connected to the electrical contacts (not shown )as the wires sealingly extend through sealing holes 53*a*.

As can be seen from FIGS. 2 and 3, the inner housing 20 of the waterproof electrical connector 10 has two rows of contact-receiving cavities 23, 24 and hollow cavities 25, 26, 27 located near the contact-receiving cavities but having no contacts therein. Three hollow cavities 25 open only to the surface of the mating housing 15 through ports 41 of the retaining member 40. The hollow cavities 25 can be used, for example, to accept ribs provided on the mating connector to prevent gouging during the joining of the connectors, or they may be just left as hollow cavities. The advantages of these cavities are explained below. Hollow cavities 26 are formed near the upper end of housing 20. The hollow cavities 26 are connected to the surface of the mating connector through relatively small diameter openings 42 of the retaining member 40. The hollow cavities 26 are connected to the wire-sealing section 53 of the waterproof-sealing member 50 through holes 26*a* of small diameter. The hollow cavity 27 is similar to the hollow cavities 25 but larger than each cavity 25; it is connected to the surface of the mating connector through port 43 of the retaining member 40.

The wire-sealing section 53 of the waterproof-sealing member 50 has round cavities 55 aligned with the small diameter holes 26*a*. Inside the cavities 55, a thin-wall partition constituting a pressure-reducing structure 56 is provided that divides the cavity 55 in two parts. The thin-wall partition 56 maintains the water tightness even when it is moved back or forward. The thin wall partition 56 is dome shaped.

As was mentioned above, when conventional waterproof connectors are coupled and their waterproof sealing units join each other, the air has no openings to escape and it is compressed. Therefore, the operator joining the mating of the connectors has to overcome the air pressure resistance in addition to the normal coupling resistance, which requires extra time and can lead to reduced reliability of the connection. The cavity 55 and thin-wall partition 56 therein make it possible to solve this problem.

When the waterproof electrical connector 10 is coupled with a mating connector, air trapped between the coupling-sealing section 52 of the waterproof sealing member 50 and the mating housing of the mating connector, and there is no escape route for the air, the air pressure rises in the inner housing 20. But in this case, the air pressure is reduced due to deformation of the thin-wall partition 56 (its stretch deformation). Therefore, the thin-wall partition 56 makes it possible to reduce the air pressure trapped in the vicinity of the mating housing.

The configuration and dimensions of the thin-wall partition 56 depends on the number of the electrical contacts and their overall dimensions. For example, the thin-wall partition 56 may be made in the form of a dome bulging forward toward a front end of the cavity 55 rather than to the back end as shown in FIGS. 3 and 4. It is also possible to make the pressure-reducing structure larger.

The hollow cavities 25, 27 that are not used also contribute to the reduction of the air pressure, due to the fact that the enclosed volume occupied by the air under pressure is larger resulting in a lower pressure.

Above, an explanation concerning a preferred embodiment of the waterproof electrical connector according to the present invention has been set forth. However, this embodiment is only an example and the present invention by no means is limited to the example described herein, various changes and modifications may therefore be made.

A specific feature of the waterproof electrical connector according to the present invention is a deformable pressure-reducing structure of a waterproof-sealing member which makes it possible to reduce inner pressure of the air trapped and compressed inside the housing when the connector is coupled with a mating connector, thus facilitating the task of joining the mating connectors and improving reliability of the electrical connections by eliminating the coupling defects.

What is claimed is:

1. A waterproof electrical connector for matable connection with a mating connector, comprising:

a housing having contact-receiving cavities in which electrical contacts are to be disposed;

a waterproof-sealing member in the housing including a coupling-sealing section for sealing engagement with a mating housing of the mating connector and a wire-sealing section through which electrical wires to be electrically connected to the electrical contacts sealingly extend;

wherein said housing and said waterproof-sealing member define at least one internal space having a certain volume when the connector is in an unconnected state; and a pressure-reducing structure provided inside a cavity in the wire-sealing section which deforms to increase the volume of said internal space when the connector is in a connected state, the pressure-reducing section being deformable in a direction which is essentially parallel to the longitudinal axis of the electrical contacts, whereby as the pressure-reducing section is deformed, the outer dimensions of the electrical connector remain constant.

2. A waterproof electrical connector as claimed in claim 1, wherein said housing includes an inner housing and an outer housing with the waterproof-sealing member disposed therebetween.

3. A waterproof electrical connector as claimed in claim 2, wherein the coupling-sealing section is disposed along the inner housing and the wire-sealing section is located at a rear end of said outer housing.

4. A waterproof electrical connector as claimed in claim 2, wherein the inner housing has a hollow cavity extending therethrough in alignment with the pressure-reducing structure.

5. A waterproof electrical connector as claimed in claim 4, wherein the pressure-reducing structure comprises a cavity and a deformable wall dividing the cavity in two parts.

6. A waterproof electrical connector as claimed in claim 5, wherein a hole in the inner housing connects the hollow cavity therein with the deformable wall.

7. A waterproof electrical connector as claimed in claim 6, wherein a retaining member is mounted at a front end of said inner housing and includes an opening in communication with said hollow cavity.

8. A waterproof electrical connector as claimed in claim 5, wherein said deformable wall has a dome shape.

9. A waterproof electrical connector as claimed in claim 2, wherein flexible latching arms are provided on said inner housing for latchably mounting said inner housing and said outer housing together securing said waterproof-sealing member therebetween.

10. A waterproof electrical connector as claimed in claim 4, wherein the inner housing includes additional cavities.

11. A waterproof electrical connector for matable connection with a mating connector, comprising:

a body which defines at least one internal space having a certain volume when the connector is in an unconnected state; and a pressure-reducing structure which provides for an increase in said volume when the connector is in a connected state, the pressure-reducing section being provided within the electrical connector and being deformable in a direction which is essentially parallel to the axis of insertion when the electrical connector is moved from the unconnected state to the connected state.

whereby as the pressure-reducing section is deformed, the outer dimensions of the electrical connector remain constant.

12. A waterproof electrical connector as claimed in claim 11, wherein said pressure-reducing structure deforms to increase said volume when the connector is in said connected state.

13. A waterproof electrical connector as claimed in claim 12, wherein said pressure-reducing structure comprises a deformable wall having one side in fluid communication with said internal space and an opposite side open to ambient conditions.

14. A waterproof electrical connector as claimed in claim 13, wherein said body further comprises a waterproof-sealing member having a coupling-sealing section for sealing engagement with a mating housing of the mating connector and a wire-sealing section through which electrical wires to be electrically connected to the electrical contacts sealingly extend.

15. A waterproof electrical connector as claimed in claim 14, wherein said body further comprises an inner housing and an outer housing with the waterproof-sealing member disposed therebetween.

16. A waterproof electrical connector as claimed in claim 15, wherein said deformable wall has a dome shape.

17. A waterproof electrical connector as claimed in claim 16, wherein said pressure-reducing structure comprises a cavity and said deformable wall divides the cavity in two parts.

18. A waterproof electrical connector for matable connection with a mating connector, comprising:

a housing having contact-receiving cavities in which electrical contacts are to be disposed;

a waterproof-sealing member in the housing including a coupling-sealing section for sealing engagement with a mating housing of the mating connector and a wire-sealing section through which electrical wires to be electrically connected to the electrical contacts sealing extend; and a pressure-reducing structure provided by the wire-sealing section for reducing the air pressure that is trapped within the connector when it is mated with the mating connector, said pressure-reducing structure comprising a cavity and a deformable wall dividing the cavity in two parts, the deformable wall being deformed in a direction which is essentially parallel to the direction of mating, whereby as the deformable wall is deformed, the deformable wall is maintained in the cavity to maintain the outer dimensions of the electrical connector constant.

19. A waterproof electrical connector as claimed in claim 18, wherein said housing includes an inner housing and an outer housing with the waterproof-sealing member disposed therebetween, and wherein said inner housing comprises:

a hollow cavity extending therethrough in alignment with the pressure-reducing structure; and a hole which connects the hollow cavity with the deformable wall.

20. A waterproof electrical connector as claimed in claim 19, wherein a retaining member is mounted at a front end of said inner housing and includes an opening in communication with said hollow cavity.

21. A waterproof electrical connector as claimed in claim 18, wherein said deformable wall has a dome shape.

* * * * *